US009039492B2

(12) United States Patent
Sun et al.

(10) Patent No.: US 9,039,492 B2
(45) Date of Patent: May 26, 2015

(54) ENCLOSED POLISHING APPARATUS

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Zhi-Guo Sun, Shenzhen (CN); Jun-Lin Peng, Shenzhen (CN); Yu-Lun Li, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 96 days.

(21) Appl. No.: 13/753,662

(22) Filed: Jan. 30, 2013

(65) Prior Publication Data

US 2013/0217311 A1 Aug. 22, 2013

(30) Foreign Application Priority Data

Feb. 20, 2012 (CN) ..... 2012 1 0037713

(51) Int. Cl.

| | |
|---|---|
| ***B24B 41/02*** | (2006.01) |
| ***B24B 19/22*** | (2006.01) |
| ***B24B 47/12*** | (2006.01) |
| ***B24B 9/00*** | (2006.01) |

(52) U.S. Cl.

CPC ..... *B24B 41/02* (2013.01); *B24B 47/12* (2013.01); *B24B 9/00* (2013.01)

(58) Field of Classification Search

CPC ..... B24B 1/00; B24B 19/00; B24B 55/06; B24B 41/02

USPC ..... 451/340, 357, 451, 456, 453, 270, 271, 451/44

See application file for complete search history.

(56) References Cited

U.S. PATENT DOCUMENTS

| | | | | | |
|---|---|---|---|---|---|
| 203,993 | A | * | 5/1878 | Bevan | 451/271 |
| 396,162 | A | * | 1/1889 | Hurth | 451/271 |
| 3,421,168 | A | * | 1/1969 | Bartel | 15/21.1 |
| 4,654,917 | A | * | 4/1987 | Yeung | 15/97.1 |
| 6,039,637 | A | * | 3/2000 | Hutchison et al. | 451/271 |

* cited by examiner

*Primary Examiner* — Robert Rose

(74) *Attorney, Agent, or Firm* — Novak Druce Connolly Bove + Quigg LLP

(57) ABSTRACT

An enclosed polishing apparatus include a housing, a fixing seat, a guiding mechanism, and a chain-driven polishing mechanism. The housing includes a bottom housing and a top housing connected to the bottom housing. The fixing seat is securely placed in the bottom housing. The guiding mechanism is placed in the top housing above the fixing seat. The polishing mechanism is movably mounted on the guiding mechanism above the fixing seat. The polishing mechanism is driven and guided by the guiding mechanism to follow a desired polishing contour on a workpiece.

20 Claims, 6 Drawing Sheets

ENCLOSED POLISHING APPARATUS

BACKGROUND

1. Technical Field

The present disclosure relates to polishing apparatus, and particularly to an enclosed polishing apparatus.

2. Description of Related Art

During a machining process, workpieces are usually polished to obtain a high gloss. During a polishing process, fine dust from the workpiece may fall on a polished surface of the workpiece such that the gloss of the polished surface is affected, and fine dust also creates a dusty work environment. A final manual cleaning may be required to complete the polishing process.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
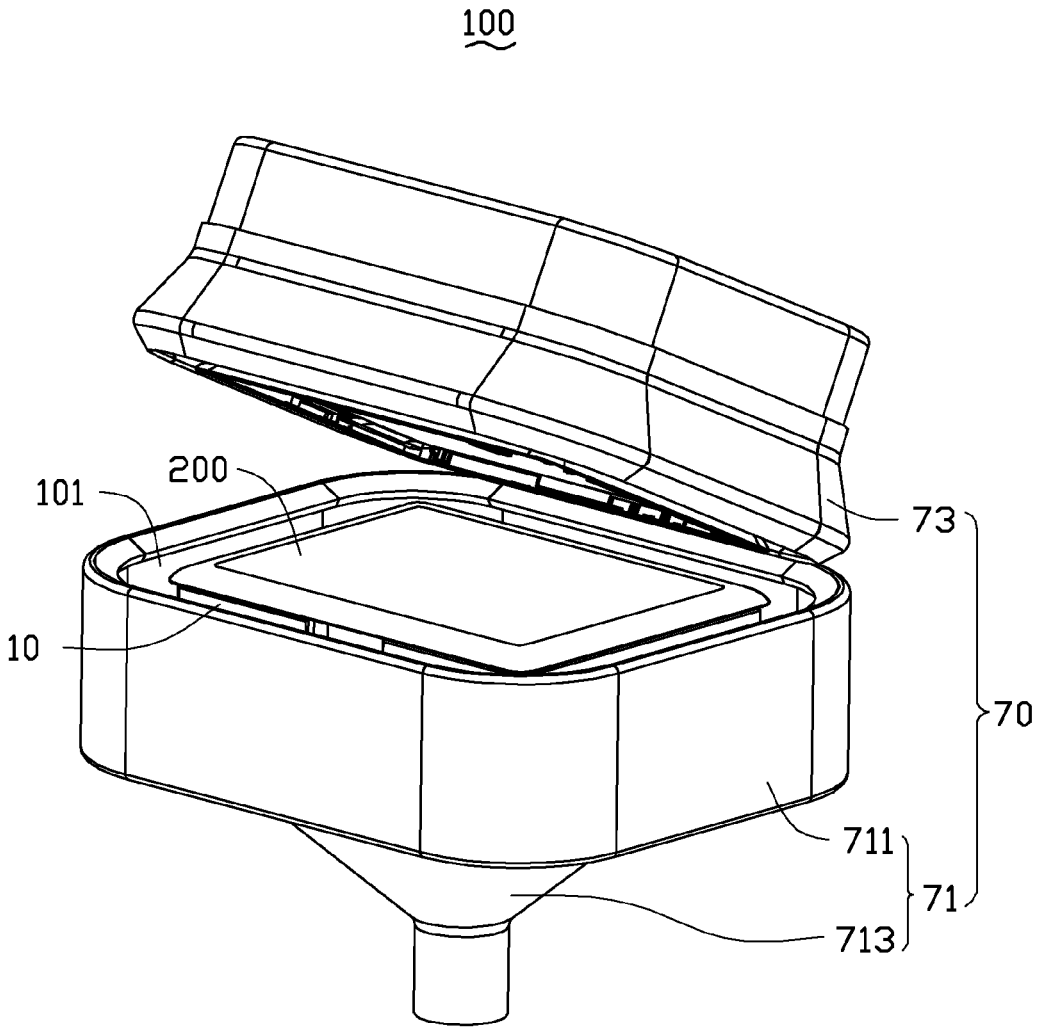
FIG. 1 is an assembled, isometric view of an embodiment of an enclosed polishing apparatus including a guiding mechanism and a polishing mechanism, wherein a workpiece is placed in the enclosed polishing apparatus.
Figure 2:
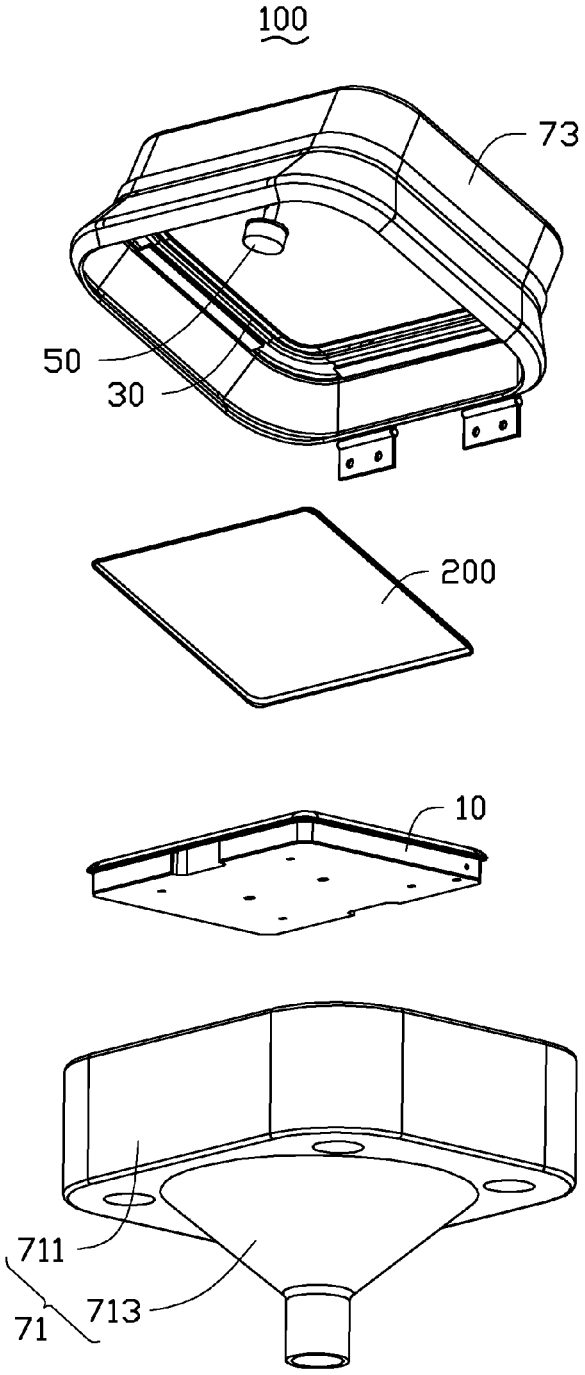
FIG. 2 is an exploded, isometric view of the enclosed polishing apparatus of FIG. 1.

FIGS. 1 and 2 show an embodiment of an enclosed polishing apparatus 100. The enclosed polishing apparatus 100 is used for polishing a workpiece 200. The workpiece 200 is substantially rectangular. A periphery of the workpiece 200 is required to be polished. The enclosed polishing apparatus 100 includes a housing 70, a fixing seat 10, a guiding mechanism 30, and a polishing mechanism 50. The fixing seat 10, the guiding mechanism 30 and the polishing mechanism 50 are received in the housing 70. The workpiece 200 is securely placed on the fixing seat 10. The polishing mechanism 50 is movably mounted on the guiding mechanism 30. The polishing mechanism 50 is moved and guided by the guiding mechanism 30.

The housing 70 includes a bottom housing 71 and a top housing 73 matched with the bottom housing 71. The bottom housing 71 and the top housing 73 cooperatively form a substantially enclosed receiving space (not labeled). The bottom housing 71 includes a body portion 711 and an extension portion 713 extending from the body portion 711 away from the top housing 73. The body portion 711 is substantially rectangular. The extension portion 713 is substantially a funnel, and communicates with the receiving space, for connecting to an external air extractor. Thus, dust and powder waste produced during polishing is extracted out by the external air extractor. The top housing 73 is substantially rectangular. The top housing 73 is rotatably connected to the body portion 711 of the bottom housing 71. In other embodiments, shapes of the bottom housing 71 and the top housing 73 can be changed to suit the shape of the workpiece 200, as long as the receiving space defined by the bottom housing 71 and the top housing 73 is big enough to receive the workpiece 200.

In the illustrated embodiment, the fixing seat 10 is substantially rectangular and plate-like. The fixing seat 10 includes a positioning portion (not labeled). The positioning portion is matched with an inner wall of the workpiece 200, for securely fixing the workpiece 200. The fixing seat 10 is securely placed in the body portion 711 of bottom housing 71. A gap 101 is formed between a periphery of the fixing seat 10 and an inner sidewall of the body portion 711. The gap 101 communicates with the extension portion 713. The gap 101 serves as an exit for the dust and powder waste. During polishing, the dust and powder waste is extracted out through the gap 101 by the external air extractor.

Figure 3:
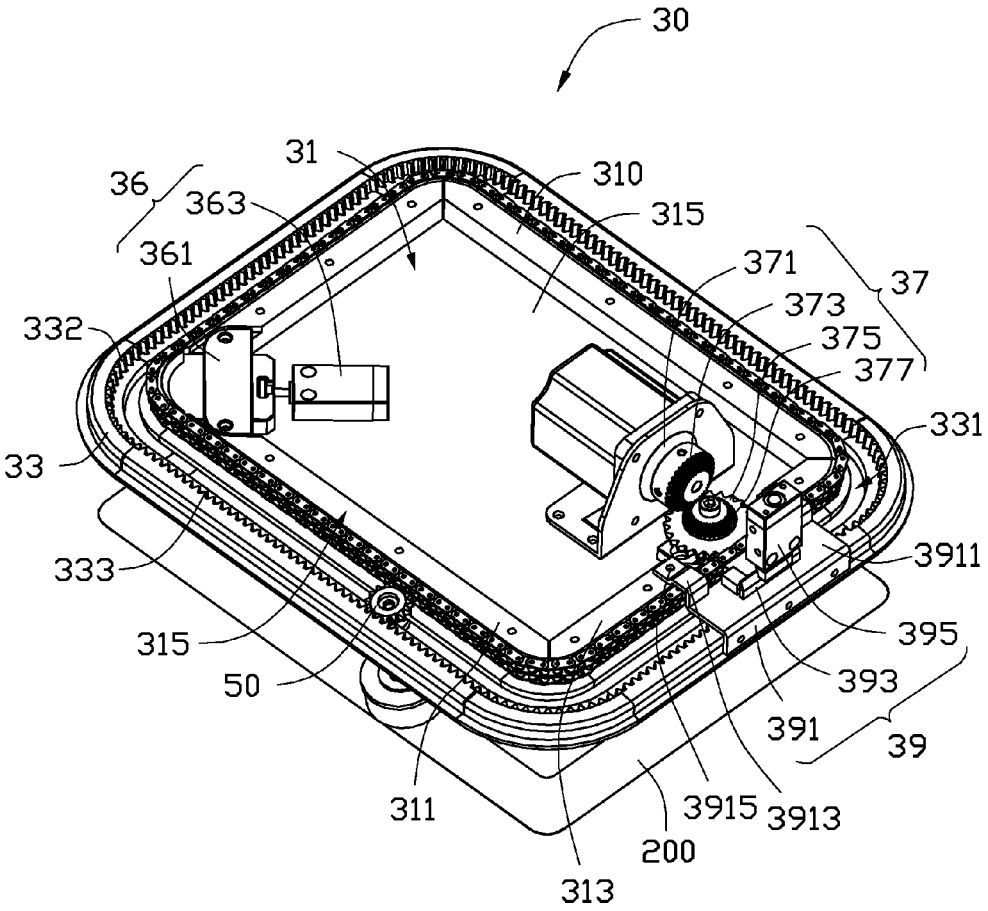
FIG. 3 is a partial, isometric view of the enclosed polishing apparatus of FIG. 1.
Figure 4:
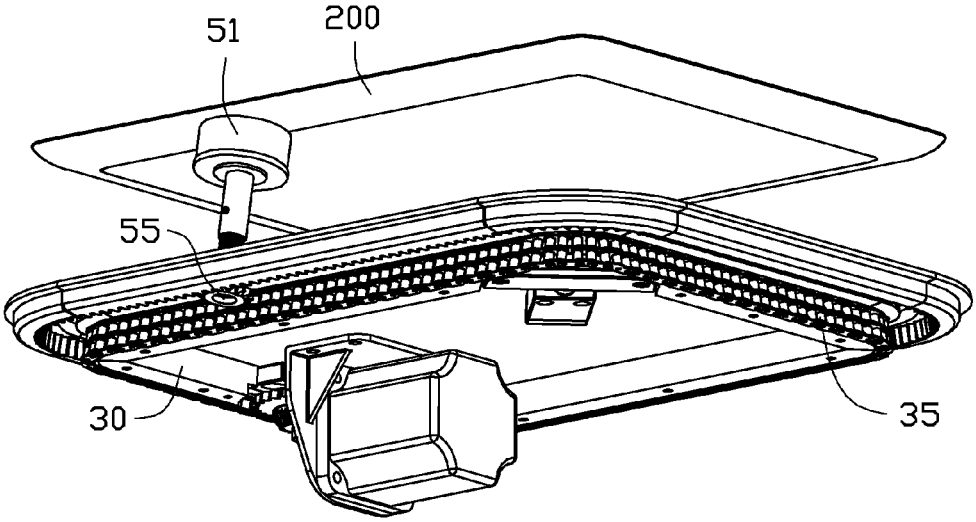
FIG. 4 is similar to FIG. 3, but viewed from another aspect.

Referring to FIGS. 3 and 4, the guiding mechanism 30 is mounted on an inner sidewall of the top housing 73, and is positioned above the fixing seat 10. The guiding mechanism 30 drives and guides the polishing mechanism 50. The guiding mechanism 30 includes a mounting base 31, a matching member 33, a chain assembly 35, a pushing assembly 36, a driving assembly 37, and an adjustment assembly 39.

The mounting base 31 includes a main body 315, and a guiding portion 310. The main body 315 is substantially rectangular and plate-like. The matching member 33 is a substantially rectangular protrusion extending outward along a periphery of the main body 315. The guiding portion 310 is also a substantially rectangular protrusion extending outward from the main body 315 and separately along the matching member 33, for mounting the chain assembly 35. In the illustrated embodiment, the guiding portion 310 includes opposite first guiding portions 311 and opposite second guiding portions 313. Connecting corners of each of the first guiding portions 311 and each of the second guiding portions 313 are rounded.

The matching member 33 surrounds the guiding portion 310. A guiding groove 331 is formed between the matching member 33 and the guiding portion 310. The matching member 33 includes an inner sidewall 332 facing the guiding portion 310. A plurality of teeth 333 are defined in the inner sidewall 332. In other embodiments, a shape of the guiding groove 331 can be changed to suit the shape of a polishing area of the workpiece 200.

The chain assembly 35 runs around the guiding portion 310, in the guiding groove 331 opposite to the teeth 333. The chain assembly 35 and the teeth 333 cooperatively form a guiding rail (not labeled). In the illustrated embodiment, the chain assembly 35 includes two chain sections. In other embodiments, the chain assembly 35 can include other chain sections.

The pushing assembly 36 is placed on the mounting base 31, for applying pressure to the guiding portion 310. In the illustrated embodiment, the pushing assembly 36 is placed adjacent to one corner of the guiding portion 310. The pushing assembly 36 includes a pushing member 361 and a driving member 363 driving the pushing member 361. The pushing member 361 is movably placed between and resists against one of the first guiding portions 311 and one of the second guiding portions 313, such that the chain assembly 35 is held at the correct tension.

The driving assembly 37 is mounted on the mounting base 31, for driving the chain assembly 35 to run within the guiding groove 331. In the illustrated embodiment, the driving assembly 37 includes a driving member 371, an action wheel 373, a driven wheel 375, and a driving gear 377. The driving member 371 is placed on the mounting base 31 away from the pushing assembly 36. The action wheel 373 is connected to and driven by the driving member 371. The driven wheel 375 is meshed with the action wheel 373, and is non-rotatably and coaxially connected to the driving gear 377. The driving gear 377 is slidably placed on the mounting base 31. The driving gear 377 meshes with the chain assembly 35, such that the chain assembly 35 is driven to circulate by the driving assembly 37.

The adjustment assembly 39 is mounted on an edge of the mounting base 31 opposite to the driving assembly 37, for adjusting the meshing between the chain assembly 35 and the driving gear 377. The adjustment assembly 39 includes a pressing plate 391, an adjusting member 393, and a driving member 395. The pressing plate 391 includes a main body 3911, a receiving portion 3913, and a fixing portion 3915. The main body 3911 is placed on the matching member 33. The receiving portion 3913 extends from two ends of the main body 3911 above the chain assembly 35. The fixing portion 3915 extends from the receiving portion 3913 away from the main body 3911. The fixing portion 3915 is securely placed on the guiding portion 310. The adjusting member 393 is movably mounted on the main body 3911. The adjusting member 393 resists against the chain assembly 35, so that the driving gear 377 is constantly meshed with the chain assembly 35. The driving member 395 is connected to the adjusting member 393, for driving the adjusting member 393.

Figure 5:
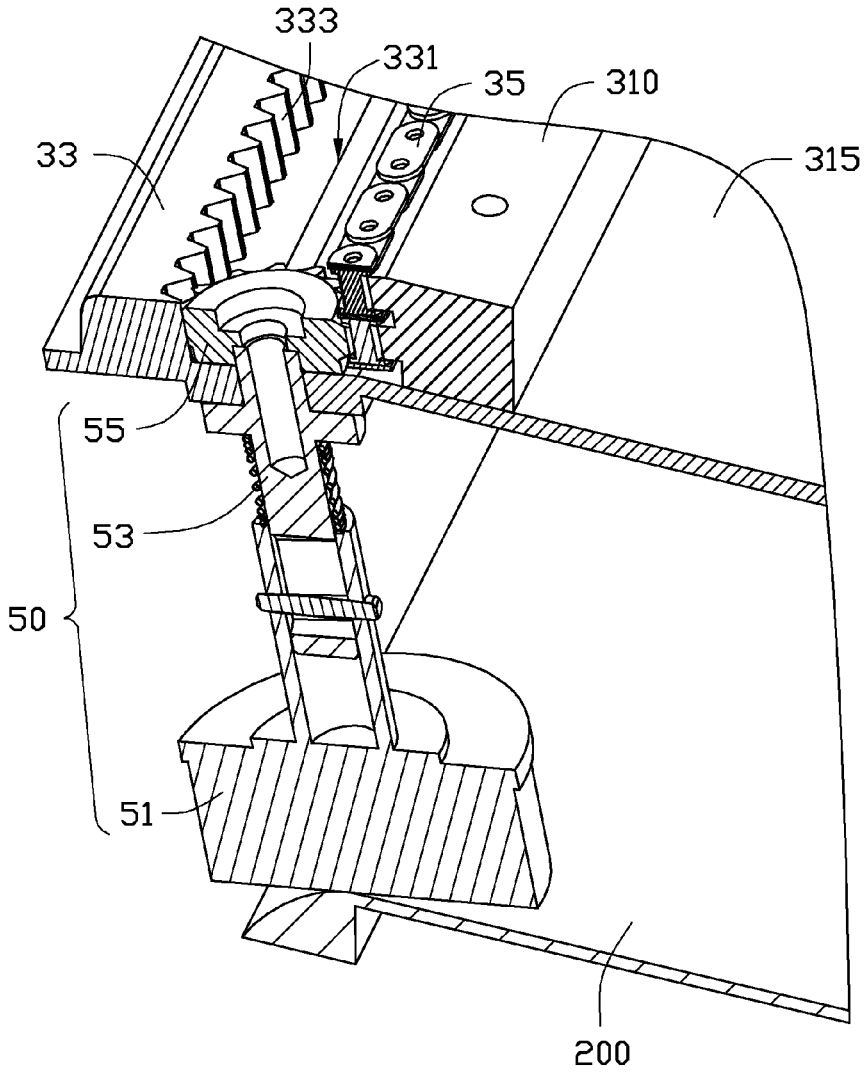
FIG. 5 is a partial, cut-away view of the enclosed polishing apparatus of FIG. 3.
Figure 6:
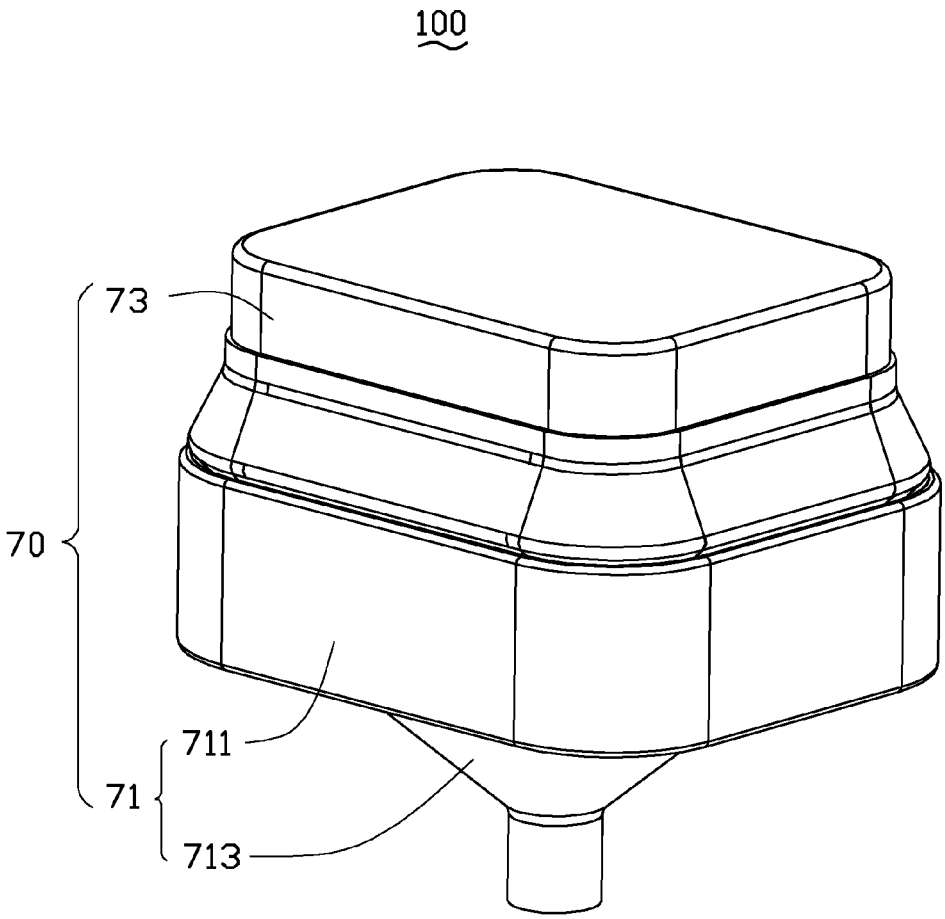
FIG. 6 is an assembled, isometric view of the enclosed polishing apparatus of FIG. 1 during a polishing operation.

Referring to FIG. 5, the polishing mechanism 50 is movably mounted on the guiding rail of the guiding mechanism 30, and moves along the guiding groove 331 driven by the guiding mechanism 30. In one embodiment, the polishing mechanism 50 includes a polishing member 51, a connecting shaft 53, and an engaging gear 55. The polishing member 51 is connected to one end of the connecting shaft 53, toward and above the fixing seat 10. The engaging gear 55 is connected to the other end of the connecting shaft 53. The engaging gear 55 is movably mounted between and meshed with the teeth 333 of the matching member 33 and the chain assembly 35.

In assembly, firstly, the chain assembly 35 and the matching member 33 are movably mounted on the mounting base 31, and the pushing assembly 36 is movably mounted on one corner of the chain assembly 35 between one of the first guiding portions 311 and one of the second guiding portions 313. Secondly, the driving assembly 37 is mounted on the mounting base 31, and is meshed with the chain assembly 35. Thirdly, the polishing mechanism 50 is mounted on the mounting base 31, the polishing member is opposite to the fixing seat 10, and the engaging gear 55 is movably engaged in the guiding groove 331. Fourthly, the adjustment assembly 39 is mounted on the edge of the mounting base 31 opposite to the driving assembly 37. Fifthly, the mounting base 31 is securely mounted in the top housing 73, and the fixing seat 10 is securely placed in the bottom housing 71. Finally, the bottom housing 71 is rotatably connected to the top housing 73 to complete the assembly of the enclosed polishing apparatus 100.

In usage, firstly, the workpiece 200 is securely fixed on the fixing seat 10, and the housing 70 is closed. Secondly, the driving assembly 37 is started to drive the chain assembly 35, the chain assembly 35 then moves along the guiding portion 310, and thereby the engaging gear 55 of the polishing mechanism 50 is moved by the chain assembly 35. The polishing member 51 is moved along by the engaging gear 55, and an edge of the workpiece 200 is thus polished by the polishing member 51. The dust and powder waste produced during polishing is extracted out through the gap 101 by the external air extractor.

The housing 70 is closed during polishing, and the dust and powder waste is extracted out through the gap 101 by the external air extractor, such that the dust and powder waste is not allowed to fall on a surface of the workpiece 200 and so contaminate it, and a work environment is also kept cleaner.

While various embodiments have been described and illustrated, the disclosure is not to be construed as being restricted thereto. Various modifications can be made to the embodiments by those skilled in the art without departing from the true spirit and scope of the disclosure as defined by the appended claims.

What is claimed is:

1. An enclosed polishing apparatus, comprising:

a housing comprising a bottom housing and a top housing connected to the bottom housing;

a fixing seat securely placed in the bottom housing;

a guiding mechanism placed in the top housing and above the fixing seat, wherein the guiding mechanism comprises a mounting base and a matching member, the mounting base comprises a main body and a guiding portion being a first protrusion extending outwardly from the main body, the matching member being a second protrusion extending outward along a periphery of the main body and separately along the first protrusion, thereby a guiding groove being formed between the first protrusion and the second protrusion; and a polishing mechanism movably mounted in the guiding groove and above the fixing seat, the polishing mechanism being driven and guided by the guiding mechanism.

2. The enclosed polishing apparatus of claim 1, wherein a gap is formed between the fixing seat and the bottom housing to facilitate powder wastes produced during polishing to be extracted out through the gap.

3. The enclosed polishing apparatus of claim 2, wherein the bottom housing comprises a body portion and an extension portion extending from the body portion away from the top housing, the extension portion is substantially hollow and communicates with the gap.

4. The enclosed polishing apparatus of claim 1, wherein the guiding mechanism further comprises a chain assembly, the chain assembly is movably sleeved on the guiding portion in the guiding groove, and the polishing mechanism is moved by the chain assembly along the guiding portion.

5. The enclosed polishing apparatus of claim 4, wherein the matching member comprises an inner sidewall facing the guiding portion, and a plurality of teeth in the inner sidewall of the matching member and opposite to the chain assembly, the plurality of teeth and the chain assembly cooperatively form a guiding rail, and the polishing mechanism is movably placed on the guiding rail.

6. The enclosed polishing apparatus of claim 5, wherein the polishing mechanism comprises an engaging gear, and the engaging gear is movably mounted between and meshed with the plurality of teeth and the chain assembly.

7. The enclosed polishing apparatus of claim 6, wherein the polishing mechanism comprises a polishing member connected to the engaging gear, the polishing member is placed opposite to and above the fixing seat.

8. The enclosed polishing apparatus of claim 4, wherein the guiding portion further comprises a first guiding portion and a second guiding portion adjacent to the first guiding portion, the guiding mechanism further comprises a pushing assembly, the pushing assembly is movably placed between and resists against the first guiding assembly and the second guiding assembly, the pushing assembly is configured to tighten the guiding portion.

9. The enclosed polishing apparatus of claim 4, wherein the guiding mechanism further comprises a driving assembly configured to drive the chain assembly.

10. The enclosed polishing apparatus of claim 9, wherein the driving assembly comprises a driving member, an action wheel, a driven wheel, and a driving gear, the driving member is placed on the mounting base, the action wheel is connected to and driven by the driving member, the driven wheel is meshed with the action wheel and non-rotatably and coaxially connected to the driving gear, the driving gear is slidably placed on the mounting base and meshed with the chain assembly.

11. The enclosed polishing apparatus of claim 10, wherein the guiding mechanism further comprises an adjustment assembly, the adjusting assembly comprises a pressing plate and an adjusting member movably mounted on the pressing plate, the adjusting member resists against the chain assembly so that the driving gear is meshed with the chain assembly.

12. The enclosed polishing apparatus of claim 1, wherein the bottom housing is rotatably connected to the top housing.

13. An enclosed polishing apparatus, comprising:

a housing comprising a bottom housing and a top housing rotatably connected to the bottom housing;

a fixing seat securely placed in the bottom housing, a gap being formed between the fixing seat and the bottom housing to facilitate powder wastes produced during polishing to be extracted out through the gap;

a guiding mechanism placed in the top housing and above the fixing seat, wherein the guiding mechanism comprises a mounting base and a matching member, the mounting base comprises a main body and a guiding portion being a first protrusion extending outwardly from the main body, the matching member being a second protrusion extending outward along a periphery of the main body and separately along the first protrusion, thereby a guiding groove being formed between the first protrusion and the second protrusion; and a polishing mechanism movably mounted in the guiding groove and above the fixing seat, the polishing mechanism being driven and guided by the guiding mechanism.

14. The enclosed polishing apparatus of claim 13, wherein the bottom housing comprises a body portion and an extension portion extending from the body portion away from the top housing, the extension portion is substantially hollow and communicates with the gap.

15. The enclosed polishing apparatus of claim 13, wherein the guiding mechanism further comprises a chain assembly, the chain assembly is movably sleeved on the guiding portion in the guiding groove, and the polishing mechanism is moved by the chain assembly along the guiding portion.

16. The enclosed polishing apparatus of claim 15, wherein the matching member comprises an inner sidewall facing the guiding portion, and a plurality of teeth in the inner sidewall of the matching member and opposite to the chain assembly, the plurality of teeth and the chain assembly cooperatively form a guiding rail, and the polishing mechanism is movably placed on the guiding rail.

17. The enclosed polishing apparatus of claim 16, wherein the polishing mechanism comprises an engaging gear, and the engaging gear is movably mounted between and meshed with the plurality of teeth and the chain assembly.

18. The enclosed polishing apparatus of claim 17, wherein the polishing mechanism comprises a polishing member connected to the engaging gear, the polishing member is placed opposite to and above the fixing seat.

19. The enclosed polishing apparatus of claim 15, wherein the guiding portion comprises a first guiding portion and a second guiding portion adjacent to the first guiding portion, the guiding mechanism further comprises a pushing assembly, the pushing assembly is movably placed between and resists against the first guiding assembly and the second guiding assembly, the pushing assembly is configured to tighten the guiding portion.

20. The enclosed polishing apparatus of claim 15, wherein the guiding mechanism further comprises a driving assembly driving the chain assembly, the driving assembly comprises a driving member, an action wheel, a driven wheel, and a driving gear, the driving member is placed on the mounting base, the action wheel is connected to and driven by the driving member, the driven wheel is meshed with the action wheel and non-rotatably and coaxially connected to the driving gear, the driving gear is slidably placed on the mounting base and meshed with the chain assembly.

* * * * *